United States Patent [19]

Watkins et al.

[11] Patent Number: 4,907,805

[45] Date of Patent: Mar. 13, 1990

[54] RING PUZZLE GAME

[76] Inventors: Derrall W. Watkins; Douglas W. Watkins, both of 5838 N. Main St., Jacksonville, Fla. 32208

[21] Appl. No.: 8,476

[22] Filed: Jan. 29, 1987

[51] Int. Cl.[4] ..... A63F 9/08

[52] U.S. Cl. ..... 273/158

[58] Field of Search ..... 273/158

[56] References Cited

U.S. PATENT DOCUMENTS

| | | | |
|---|---|---|---|
| 498,639 | 5/1983 | Fields | 273/153 S |
| 3,706,458 | 12/1972 | Jones | 273/158 |
| 4,512,582 | 4/1985 | Dallaire et al. | 273/158 |

FOREIGN PATENT DOCUMENTS

| | | | |
|---|---|---|---|
| 2411587 | 8/1979 | France | 273/158 |

*Primary Examiner*—Anton O. Oechsle

*Attorney, Agent, or Firm*—Edward M. Livingston

[57] ABSTRACT

An improved ring puzzle game having a variable number of adjacent and overlapping rings held by closed loops contained on the top of posts inserted through apertures in a holding box, and an elongated, closed wand for passing through said rings. The object of the game is to remove and insert said wand from the rings and posts by a lengthy series of complex manipulations. Removable nuts are provided on the lower ends of the post so that the number of rings can be varied, thus varying the degree of difficulty of the puzzle. The holding box covers the sharp bottoms of the posts to prevent cutting of fingers or tearing clothing. In addition, the holding box also doubles as a storage box for loose rings, posts and game materials while the game is not in use.

3 Claims, 1 Drawing Sheet

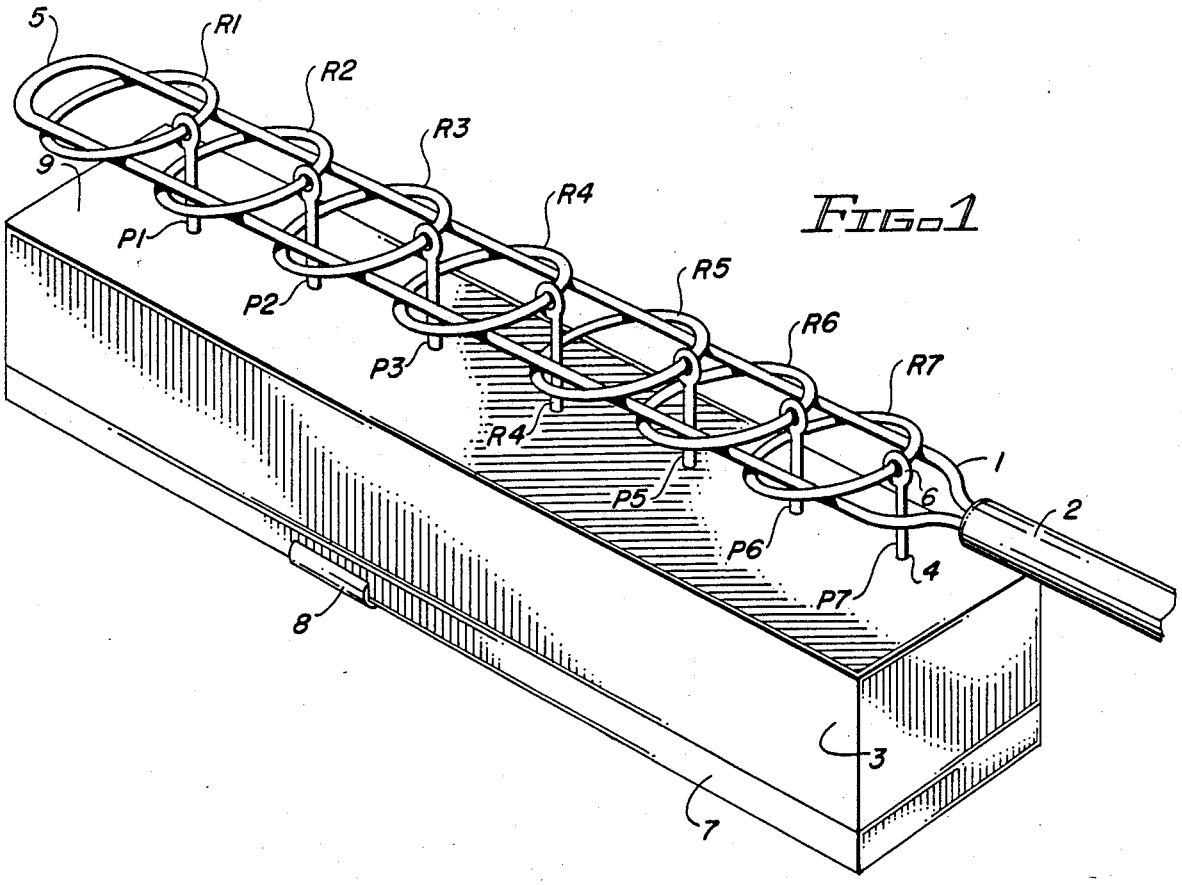
FIG. 1
FIG. 2
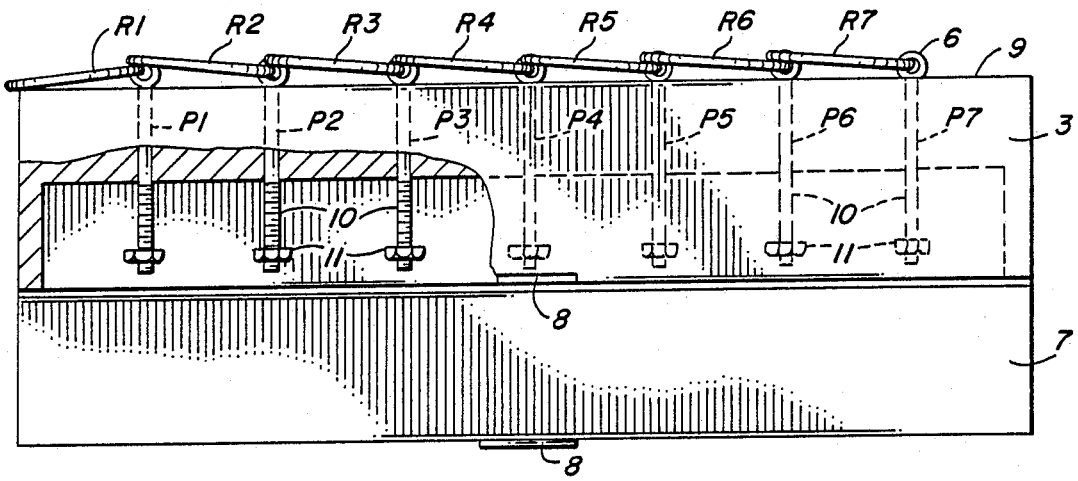
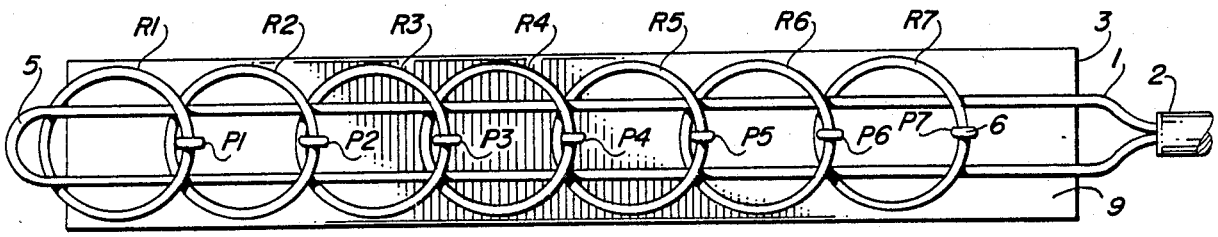
FIG. 3

RING PUZZLE GAME

BACKGROUND OF THE INVENTION

This invention relates generally to games and puzzles and more particularly to ring puzzle games.

Games and puzzles of this type generally consist of a number of rings loosely anchored by posts in a flat base member. An elongated closed loop made of wire straddles the posts and passes through the rings. The solution to the puzzle, that is, removing and replacing of the loop, involves a long series of manipulations.

The prior art includes numerous puzzle games, such as U.S. Pat. Nos. 4,036,504 to Touchette; 4,000,901 to Flores; 3,698,719 to Winslow; and 3,706,458 to Jones. The Touchette patent depicts a puzzle game having U-shaped handles on the end of the wire loop and on the flat base to make manipulations easier. Unfortunately, the Touchette patent offers no solution to the game. The Flores patent is a similar ring puzzle game having a flat base but no handle on the loop. Again, the Winslow patent shows a ring puzzle game that also has a flat base and a separating wire loop member. Finally, the Jones patent has a flat base like the above-mentioned patents but provides a means for a changeable number of rings.

There are numerous problems with the patented ring puzzle games in the prior art.

First, since the ring puzzle game is so difficult to solve, a means is needed by which the number of rings can be adjustable so the user can begin with a few rings and then increase the number of rings as his skill improves. Although the Jones patent cited above does provide for a changeable number of rings, the patent provides for no place to store the unused number of rings.

The second problem with prior patents is that all of the ring puzzles require one hand to hold the game and the other must be used to manipulate the loop through the rings, thereby making it tiresome to play. Both hands are needed to manipulate the rings and loop and prior inventions cannot be set down to play without losing one's place in the puzzle.

A third problem is that the prior ring puzzle games do not provide any covering for the bottom of the posts which are made of pointed and sharp metal. Such exposure of the metal often results in clothes being torn or fingers cut.

The instant invention solves these problems associated with the prior art by providing a ring puzzle game which, instead of being mounted on a flat base, is mounted in a rectangular box-like container which not only covers the exposed metal of the posts but also acts as a platform which can be rested on a table. In this manner, the hand required to hold the game is freed up so that it is possible to manipulate the rings and the loop with both hands. In addition, the holding box also acts as a storage cabinet for additional rings by providing a cover on the bottom which snaps open and shut as needed.

Thus, as outlined above this invention provides an improved ring puzzle game with a holding and storage box in addition to numerous other advantages over prior ring puzzles.

SUMMARY OF THE INVENTION

The primary object of this invention is to provide an improved ring puzzle game which enables the user to use both hands to accomplish the difficult series of manipulations necessary to solve the game.

A second object of the invention is to provide a ring puzzle game which is safer by not being able to tear clothing or cut fingers when the sharp ends of the posts are exposed.

Another object of the invention is to provide a game which has a storage box for extra rings and posts associated with the game.

An even further object of the game is to provide a puzzle which, in combination with the above advantages, provides a means of varying the degree of difficulty of the game.

The instant invention accomplishes the above-referenced objects as well as other objects by providing a ring puzzle game which has as its base a rectangular box-like container in which the posts are loosely anchored so that the game may be rested on a table, thereby freeing up both hands to play the game. In addition to holding the puzzle itself, the box also acts as a storage compartment for extra rings and posts. Moreover, since the box covers the exposed sharp ends of the posts, it prevents tearing clothing and cutting fingers and is thereby safer than prior ring puzzle games. Finally, since the game is normally very difficult to solve depending on the number of rings involved, the puzzle also provides a means of varying the number of rings by threadably removable nuts on the bottom of the posts.

Other objects, advantages and features of the invention will become readily apparent from the following detailed description of the specific embodiment thereof, when read in conjunction with the accompanying drawings.

BRIEF DESCRIPTION OF THE DRAWINGS

The drawings appended to this application are as follows:

FIG. 1 is a perspective view of the invention;

FIG. 2 is a side plan view of the invention with the holding and storage box in the open position and without the interlocking wand member; and FIG. 3 is a top view of the invention.

DESCRIPTION OF THE PREFERRED EMBODIMENT

Referring in detail to the drawings, the entire invention is illustrated in FIG. 1. The wand-like loop member designated by the numeral 1, passes through the rings, R1 through R7. Rings R1 through R7 are supported by a like number of posts, P1 through P7, which are anchored through holes 4 in the top 9 of the supporting box designated generally by the numeral 3. Each of the posts contains a closed loop 6 on the top thereof which wraps around each ring. The wand 1 has a handle 2 at the front thereof which is used to hold the wand 1 as it is manipulated through the rings R1 through R7. At the opposite end of the wand 1 is a closed end 5 which is narrow enough to pass through the rings R1 through R7.

FIG. 2 best illustrates the structure of the posts P1 through P7 by showing the posts in plan form without the wand 1 and with the bottom 7 of the holding/storage box 3 in the open position and extending downwardly from its hinge-like connection to box 3. Without the wand 1 extending through the rings R1 through R7, the posts P1 through P7 rest on the top of the box 9. When the bottom cover of the box 7 is snapped open by inserting a fingernail in the snap lock 8 and pulling downward, the bottom of the posts P1 through P7 are exposed. The bottoms of the posts 11 are threaded like a screw, thereby allowing a nut 10 to be screwed off and on the bottom of the posts. In this manner, the number of rings in the ring puzzle, whether it be seven as shown in the illustrations, or a lesser or greater number as desired by the user, may be varied.

The final drawing, FIG. 3, shows the invention as it would appear from the top with the wand 1 interlocking with the overlapping rings R1 through R7 and posts P1 through P7.

The object of the ring puzzle game is to be able to remove the wand 1 from an interlocking position with the rings R1 through R7 and P1 through P7, and afterwards to reinsert said wand 1 into the rings once again. The solution requires a complex and lengthy set of manipulations set forth below. The key to solving the puzzle involves rings R1 and R2.

To solve the instant ring puzzle game, the user must first take the wand 1 (hereinafter referred to as "W") in one hand or the other. Assuming the user is right-handed, the solution set forth hereinafter assumes the user will place his right hand on the W. The instant ring puzzle as described hereinabove has been designed to now leave the left hand free to manipulate the rings contrary to prior ring puzzles. First, pull W to the right with the right hand, pull R1 over the top of W and drop it through the center of W moving W slightly to the left to do so. Now pull W back to the right and drop R3 through W. Push W to the left and now back through R2, but over R1, then pull R1 up through center of W. Now pull W to the right, pulling it back out of R2. Now drop R1 and R2 through W and pull W to the right and drop R5 through W. Now push W to the left through R4. Then push W farther to the left and pull R1 and R2 up through the center of W. Now pull W to the right and put R2 back on W, pushing W to the left. Now drop R1 through the center of W and pull W to the right and put R3 back on W. Now push W to the left through R2 and drop R1 through the center of W. Pull W to the right and drop R1 and R2 through the center of W. Pull W farther to the right and drop R4 through center of W (now R4 and R5 are through center of W). Push W to left through R3 and push W farther left and pull R1 and R2 up through center of W. Now pull W to the right and put R2 back on W. Draw R1 back through center of W and pull W to the right, dropping R3 through the center of W (now R3, R4 and R5 are through center of W).

Now push W to the left through R2 and pull R1 up through the center of W. Pull W to the right, freeing ring R2. Now drop R1 and R2 through the center of W (now R1, R2, R3, R4 and R5 are through W). Pull W to right and push R7 through center of W (R7 is now the one ring that is a solved part of the puzzle).

Now push W to the left through R6 and farther so you can pull R1 and R2 through the center of W. Pull W to the right and put R2 back on W and drop R1 through the center of W. Pull W to the right and put R3 back on W. Push W to the left through R2 and R3 and pull R1 through the center of W. Pull W to the right and drop R1 and R2 through the center of W. Pull W to the right and put R4 on W. Now push W to the left through R3 and R4. Push W farther to the left and pull R1 and R2 through the center of W. Pull W to the right enough to put R2 on W. Push W to the left and drop R1 through the center of W. Pull W to the right and drop R3 through the center of W. Push W to the left through R2 and pull R1 up through the center of W. Pull W to the right and drop R1 and R2 through W. Pull W farther to the right and put R5 back on W. Push W to the left through R4 and R5 and put R1 and R2 up through the center of W. Pull W to the right and put R2 back on W, dropping R1 through the center of W. Then pull W to the right and put R3 on W and push W to the left through R2 and R3. Then pull R1 up through the center of W. Pull W to the right and drop R1 and R2 through the center of W. Now pull W to the right and bring R4 through the center of W. Push W to the left through R3 and pull R1 and R2 up through the center of W. Put R2 back on W and push W to the left, dropping R1 through the center of W. Pull W to the right and drop R3 off W. Push W to the left through R2 and pull R1 up through the center of W. Pull W to the right and drop off R1 and R2. Then pull W farther to the right and drop off R6 through the center of W (now R6 and R7 are the two rings that are solved parts of the puzzle).

Now push W to the left through R5 and farther so R1 and R2 can be brought up through the center of W. Pull W to the right and put R2 back on W and push W to the left and drop R1 through the center of W. Pull W to the right and pick up R3 and put on W. Push W to the left through R2 and R3. Pull R1 up through the center of W. Now drop R1 and R2 through the center of W. Pull W to the right, pick up R4 and push W to the left through R3 and R4. Then pull R1 and R2 through the center of W. Pull W to the right and put R4 back on W. Then drop R1 through the center of W. Pull W to the right and drop R3 through the center of W. Push W to the left through R2 and pull R1 up through the center of W. Now pull W to the right and drop R1 and R2 through the center of W. Now pull W to the right and free R5 through the center of W (now R5, R6 and R7 are now the three rings that are a solved part of the ring puzzle).

Now push W to the left through R4 and farther to pick up and pull R1 and R2 through the center of W. Pull W to the right and put R2 back on W and push W to the left and drop R1 through the center of W. Pull W to the right and put R3 back on W. Push W to the left through R2 and R3 and pull R1 up through the center of W. Pull W to the right and drop RI and R2 through the center of W. Pull W to the right and free R4 (now R4, R5, R6 and R7 are the four rings that are a solved part of the puzzle).

Now push W to the left through R3 and pull R1 and R2 up through the center of W. Pulling W to the right, put R2 back on W. Push W to the left, dropping R1 through the center of W. Pull W to the right, now freeing R3 (R3, R4, R5, R6 and R7 are now the five rings that are a solved part of the puzzle).

Now push W to the left through R2 and pull R1 up through the center of W. Pull W to right, now freeing R1 and R2 (R1, R2, R3, R4, R5, R6 and R7 are now the seven rings that are a solved part of the puzzle). Thus, finally, if the ring puzzle game has seven rings as illustrated, the wand 1 is free and separate from the rest of the ring puzzle game.

To replace the wand 1, the user need only reverse the above-outlined solution. When the user is done playing, in order to store the puzzle, all the user need do is to open the box 3 by inserting a fingernail in the snap lock 8 which exposes the bottom post ends 11 and nuts 10 on the end of the posts P1 through P7. By unscrewing the nuts 10, the rings and posts can be removed through the holes 4 on the top 9 of the box 3 and stored inside the box 3 so that the various parts of the game will not be lost.

As described in detail above, it should be apparent that there has been provided a new and improved ring puzzle game which has many advantages over prior games, primary among which a safety in that it provides a box which covers the exposed metal portions of the posts, thereby preventing the tearing of clothing and cutting of fingers. Also, this new ring puzzle game is easier to use and not as tiresome because the storage box also acts as a holding platform so that the game may be placed on a tabletop or held between the legs, thereby freeing up both hands to play the game. The storage box also serves as a holding bin to store the rings and game parts when it is not in use. Moreover, the instant ring puzzle game is designed so that it may be varied in difficulty depending on the skill of the user merely by unscrewing the nuts on the bottom of the posts and removing the posts through the top of the holding box, thereby leaving the number of rings desired.

While one specific embodiment of the invention has been described in detail hereinabove, it is to be understood that various modifications may be made from the specific details described hereinabove without departing from the spirit and scope of the invention as set forth in the appended claims.

We claim the following:

1. An improved ring puzzle game comprising:

a plurality of rings, variable in number, each ring held in place by being permanently enclosed within a closed loop at the top of a post and each ring overlapping each adjacent ring and post;

a plurality of posts, one for each ring, each having a closed loop at the top to encircle each ring, each post being inserted through a hole in the top of a box-like enclosure, said posts having removable means for securing said posts in place;

a wand-like elongated closed loop member having a handle at one end, said loop member being insertable and removable from an interlocking position with the rings and posts by a series of prescribed manipulations of the rings, posts and loop member; and a box-like enclosure having a plurality of aligned holes through the top thereof to hold the rings and cover the bottom of the posts, said box-like enclosure having a bottom cover which can be opened to store components of the game.

2. The improved ring puzzle game of claim 1 wherein said box-like enclosure contains a snap on and off cover on the bottom side thereof to provide access to the bottom of the posts, said cover being affixed to one side of the bottom of the box-like enclosure in a hinge-like fashion and closeable by means of an overlapping extension on the opposite side of said cover.

3. The improved ring puzzle game of claims 1 or 2, wherein the removable means for securing the posts consists of removable members threadably attached to the bottom ends of said posts which allows the user to vary the number of rings.

* * * * *